US009404210B2

(12) United States Patent
He et al.

(10) Patent No.: US 9,404,210 B2
(45) Date of Patent: Aug. 2, 2016

(54) WASHING MACHINE AND WASHING METHOD

(75) Inventors: Zhengbao He, Qingdao (CN); Chunfeng Lao, Laoshan (CN)

(73) Assignees: HAIER GROUP TECHNIQUE R & D CENTER, Qingdao, Shandong (CN); HAIER GROUP CORPORATION, Qingdao, Shandong (CN)

( * ) Notice: Subject to any disclaimer, the term of this patent is extended or adjusted under 35 U.S.C. 154(b) by 92 days.

(21) Appl. No.: 14/347,766

(22) PCT Filed: May 4, 2012

(86) PCT No.: PCT/CN2012/075074

§ 371 (c)(1), (2), (4) Date: Mar. 27, 2014

(87) PCT Pub. No.: WO2013/044634

PCT Pub. Date: Apr. 4, 2013

(65) Prior Publication Data

US 2014/0237731 A1 Aug. 28, 2014

(30) Foreign Application Priority Data

Sep. 30, 2011 (CN) ..... 2011 1 0293481

(51) Int. Cl.

| | |
|---|---|
| ***D06F 31/00*** | (2006.01) |
| ***D06F 35/00*** | (2006.01) |
| ***D06F 37/04*** | (2006.01) |
| ***D06F 39/02*** | (2006.01) |

(52) U.S. Cl.

CPC ..... *D06F 39/026* (2013.01); *D06F 31/005* (2013.01); *D06F 35/00* (2013.01); *D06F 37/04* (2013.01)

(58) Field of Classification Search

CPC ..... D06F 31/005; D06F 35/00; D06F 37/04; D06F 39/026

USPC ..... 8/158, 159; 68/29, 139, 140, 142, 143

See application file for complete search history.

(56) References Cited

U.S. PATENT DOCUMENTS

| | | | |
|---|---|---|---|
| 2,312,657 | A | 3/1943 | Locke |
| 3,803,882 | A | 4/1974 | Brennan |

(Continued)

FOREIGN PATENT DOCUMENTS

| | | | |
|---|---|---|---|
| CH | 390860 | A | 4/1965 |
| CN | 2073434 | U | 3/1991 |

(Continued)

OTHER PUBLICATIONS

International Search Report (PCT/ISA/210) mailed on Aug. 9, 2012, by the Chinese Patent Office as the International Searching Authority for International Application No. PCT/CN2012/075074.

(Continued)

*Primary Examiner* — Michael Barr

*Assistant Examiner* — Levon J Shahinian

(74) *Attorney, Agent, or Firm* — Buchanan Ingersoll & Rooney PC

(57) ABSTRACT

A washing machine and a washing method, comprises an inner cylinder, an outer cylinder, and solid particles as a washing medium. The inner cylinder is driven into rotation by a driver unit. A side wall of the inner cylinder is spirally shaped and drives the particles into a spiral movement and flipping within the inner cylinder. When the inner cylinder is spinning, the screw thread drives the particles into flipping in all directions, back-and-forth and up-and-down, within the inner cylinder, thus allowing for increased mixing between clothes and the particles, for simplified washing process while also for improved cleaning rate, and for facilitated recycling of the particles.

16 Claims, 2 Drawing Sheets

(56) References Cited

U.S. PATENT DOCUMENTS

| | | | | |
|---|---|---|---|---|
| 5,093,948 | A * | 3/1992 | Val | D06B 11/0096 68/29 |
| 2009/0038348 | A1 * | 2/2009 | Dalla Valle | D06B 5/24 68/16 |
| 2009/0165217 | A1 | 7/2009 | Pillsticker | |
| 2010/0326142 | A1 | 12/2010 | Geyer et al. | |
| 2011/0296628 | A1 | 12/2011 | Jenkins et al. | |

FOREIGN PATENT DOCUMENTS

| | | | |
|---|---|---|---|
| CN | 201092620 | Y | 7/2008 |
| CN | 101946035 | A | 1/2011 |
| DE | 10 2006 019 458 | A1 | 10/2007 |
| EP | 0 544 599 | A1 | 6/1993 |
| WO | 2009/101098 | A1 | 8/2009 |
| WO | WO 2010/094959 | A1 | 8/2010 |

OTHER PUBLICATIONS

Office Action issued by the U.S. Patent and Trademark Office on Dec. 22, 2015 in corresponding U.S. Appl. No. 14/347,785 (24 pages).

European Search Report issued on Mar. 31, 2015 by the European Patent Office, in corresponding European Patent Application No. 12835070.9. (7 pages).

* cited by examiner

WASHING MACHINE AND WASHING METHOD

FIELD OF THE INVENTION

The invention relates to a washing machine, in particular to a washing machine using solid particles during washing and a washing method thereof, which belongs to the technical field of washing machine.

BACKGROUND OF THE INVENTION

In the washing method of a traditional washing machine, the washing medium is water, adding water and detergents into the washing machine for washing; after washing, discharging the sewage from the washing machine via dewatering function, and then adding clean water again for continuing the washing or rinsing process, finally discharging water after the washing is entirely finished. In this method, the water is simply discharged and then the clean water is refilled, thus causes large water consumption. Meanwhile, lots of chemical substances which are harmful to the environment are contained in the washing liquid and the washing process is time-consuming, with large power consumption each time.

To overcome the shortcomings of the traditional washing machine, a washing method with the specially-made solid particles from the polymer material as the washing medium is provided, in which the dirt on clothes is adsorbed and then removed through the friction between the solid particles and clothes, so as to achieve the purpose of washing. The washing method can save over 80% water. Moreover, the solid particles as washing medium can be recycled and reused with a long service life, having no need to change and being safe and environmentally friendly.

A washing machine that uses the washing method is generally arranged with a storage space of particles as well as a feed opening and a discharge opening on the outer tub. Before washing, the particles is put into the outer tub from the feeding opening, and then recycled back into the storage space of particles fully after washing. During the recovery of the particles, the inner cylinder is rotating with high speed, and the particles are pushed into the storage space by the centrifugal force. If it is in need of dehydration of the particles, the particles is fed recycled again. The structure of the washing machine and the washing method are complex, and the recovery rate of particles 100% can not be guaranteed.

SUMMARY OF THE INVENTION

The main object of the invention is to solve the foregoing problems and the defects, and provides a washing machine with simple structure, simplified washing procedures, and improved the cleaning efficiency, conducive to recycle the particles.

Another object of the invention is to provide a washing method with simplified washing procedures, improved the cleaning efficiency, and conducive to the particles recycling.

In order to achieve the above purposes, the technical scheme of the invention is:

A washing machine, comprising an inner cylinder, an outer cylinder, and solid particles as a washing medium, wherein, the inner cylinder is driven to rotate by a driver unit, a side wall of the inner cylinder is spirally shaped, and the particles are driven to move and turn over spirally within the inner cylinder.

Further, a screw thread is disturbed all over the side wall of the inner cylinder from the bottom to the top.

Further, an isolated cylinder with reticular structure for separating the clothes from the particles is arranged along the inner side of the inner cylinder, and the bottom and the top of the isolated cylinder are connected fixedly with the bottom and the top of the inner cylinder respectively.

Further, a storage space for storing the particles is arranged in the washing machine, and the storage space is communicated with the inner cylinder.

Further, the storage space for storing the particles is an extension part of the inner cylinder extending from one side, and a baffle for blocking clothes is set between the storage space and the inner cylinder, and a channel for communicating the storage space with the inner cylinder each other is provided between the circumference of the baffle and the inner side wall of the inner cylinder, and the side wall of the extension part and the side wall of the inner cylinder are continuously spirally shaped.

Further, the cross section of the screw thread on the inner cylinder and the extension part is streamline.

Further, the thread on the inner cylinder and the extension part is equal screw-pitch thread or unequal screw-pitch thread.

Further, the screw-pitch of the screw thread on the inner cylinder and the extension part is greater than or equal to 5 mm, a height of the cross-section of the screw thread is greater than or equal to 5 mm.

Further, the screw-pitch of the screw thread on the inner cylinder and the extension part is 8-15 mm; the height of the cross-section of the screw thread is 8-15 mm.

Another technical scheme of the invention is:

A washing method: the side wall of the inner cylinder of the washing machine is spirally shaped, during rotating of the inner cylinder, the particles as a washing medium are driven to spirally move and turn within the inner cylinder, and thus the particles mix and turn with the clothes and the washing water, and the washing of the clothes is completed.

Further, driving the inner cylinder to continuously rotate according to the same direction or the opposite direction of the screw thread, the particles are driven to move to the side of the inner cylinder by the screw thread, finishing putting the particles in; or the particles are driven to move away from the inner cylinder by the screw thread, finishing recycling the particles.

Further, during washing the clothes, putting and recycling the particles, the inner cylinder rotates with a speed of 50-200 r/min.

Further, the storage space for storing the particles is the extension part of the inner cylinder extending from one side, the side wall of the extension part and the side wall of the inner cylinder are continuously spirally shaped, the extension part and the inner cylinder rotate synchronously, the particles are driven to move away from the inner cylinder by the screw thread and be recycled to the storage space.

Further, after the particles are recycled to the extension part, or before the particles are recycled to the extension part, or when the particles are recycled to the extension part, the inner cylinder and the extension part rotate with a speed of 100-1000 r/min, thus the particles move to the extension part, and realizing the process of dehydration and regeneration of the particles and the clothes at the same time.

Therefore, a washing machine and washing method in the invention compared with the prior art has the following advantages:

(1) The design of the inner cylinder of washing machine is spirally shaped, the screw thread alternating positive and reverse rotation, driving the clothes and the particles to spirally move in the inner cylinder, and realizing to flip in all directions, back-and-forth and up-and-down, thus allowing for fully mixing between clothes and the particles 6, also for improved cleaning rate.

(2) Through positive and reverse rotating if the screw thread continuously, the particles temporarily stored in the screw thread move forward or backward, and then realize the putting and recovery of the particles.

(3) After the particle is completely recovered to the storage space, the inner cylinder rotating with high speed, realizing the dehydration the clothes and the particles simultaneously.

(4) The invention not only simplifies the structure of washing machine, simplifies the washing procedures, but also is beneficial to the recovery of particles to 100%.

EMBODIMENTS

The invention is described in detail with the specific embodiment combining with the drawings.

Embodiment 1

Figure 1:
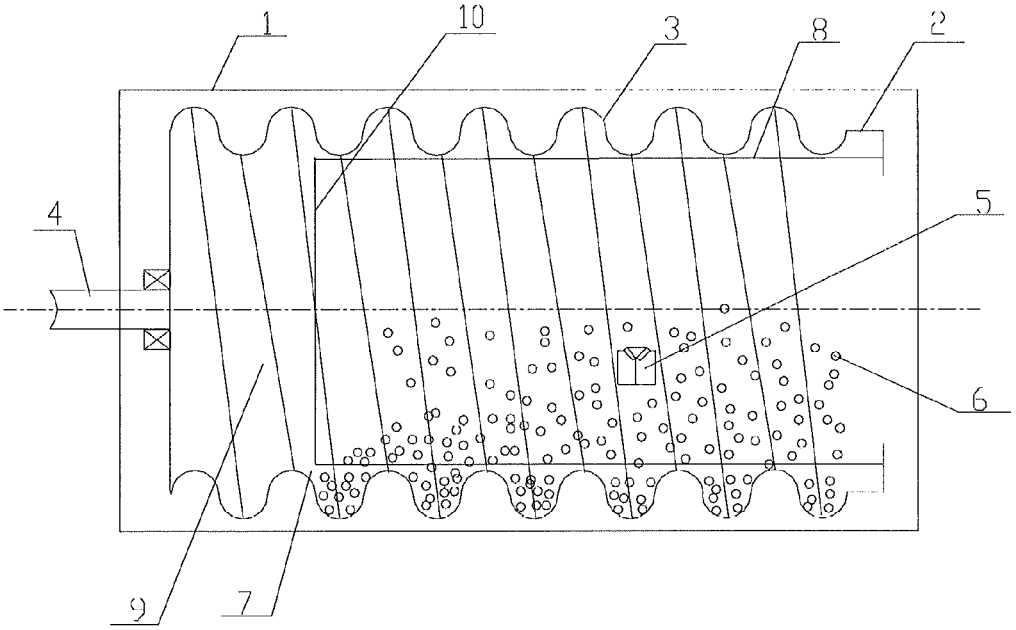
FIG. 1 is a schematic diagram of the structure of the present invention.

FIG. 1 is shown a washing machine, and a drum washing machine is taken an example for detailed description in the embodiment. The washing machine includes a housing (not shown in figure), an outer cylinder 1 arranged in the housing, an inner cylinder 2, and solid particles 6 as washing medium, wherein, the outer cylinder 1 is fixed without rotating, is mainly used for holding water; the inner cylinder 2 is used for washing. The inner cylinder 2 is arranged in the outer cylinder 1. The side wall of the inner cylinder 2 is uniformly provided with a plurality of opening holes 3 through which washing water pass. The diameter of the opening holes 3 is smaller than the one of the solid particles 6, and the shape of the holes 3 can be round, rectangle, polygon etc. The inner cylinder 2 is driven to rotate by a driving unit 4. The upper of the outer cylinder 1 is provided with a water inlet (not shown in figure) for feeding water during the washing and rinsing process. The lower of the outer cylinder 1 is provided with a water outlet (not shown in figure) for drainage after dehydration. In washing, clothes 5 are placed inside the inner cylinder 2.

The side wall of the inner cylinder 2 is spiral-shaped. In order to guarantee the particles 6 fully mixed with the clothes 5 in the inner cylinder 2, and that the particles 6 is fully recycled, the side wall of the inner cylinder is full of screw thread from the bottom to the top. In the embodiment, the cross section of the screw thread is preferably streamline shape which is roughly circular arc in shape, so that it is avoid to damaging the particles, and the storage capacity of the particles 6 in the screw thread is increased. The diameter of the particles 6 is about in the range of 2-3 mm, so the screw pitch of the screw thread is greater than or equal to 5 mm, preferably 8-15 mm, more preferably 10 mm. The height of the cross-section of the screw thread is greater than or equal to 5 mm, preferably 8-15 mm, more preferably 10 mm. The greater the screw pitch of the screw thread is, the greater the height of the cross-section is, and the great the number of the particles 6 stored in the arc thread is, and the faster the pushing speed the particles 6 driven by the screw thread is. Thus it is not only more advantaged to put and recycle the particles, but also helpful to fully mix the particles 6 with the clothes. The cleaning efficiency is further improved.

As with the common drum washing machine, the inner wall of the inner cylinder 2 is provided with at least one lifting block which is projecting inward (not shown). In the process of washing, driven by the lifting block, the clothes 5 are continually turned over up and down in the inner cylinder 2 in circle to achieve the washing effect. The number of the lifting blocks may be 1-3. In the embodiment, preferably three lifting blocks are arranged along the circumference of the inner cylinder 2 uniformly. At the same time, the inner cylinder 2 rotates alternately positively and reversely. Driven by the alternately positive and reverse rotation of the screw thread on the side wall of the inner cylinder 2, the particles 6 move and turn over along the direction of the axis of the inner cylinder 2 forward and backward. Thus the clothes 5 are more fully mixed with the particle 6 to improve the cleaning rate.

In order to separate the clothes 5 from the particles 6, an isolated cylinder 8 in which the clothes 5 are placed is provided along the inner side of the inner cylinder 2. The bottom and the top of the isolated cylinder 8 are fixedly connected with the bottom and the top of the inner cylinder 2 respectively by fastener. The isolated cylinder 8 and the inner cylinder 2 rotate synchronically. The isolated cylinder 8 is reticular structure, so that the particles 6 and washing water easily flow into or out. The clothes 5 are isolated in the isolated cylinder 8, and the particles 6 are isolated between the isolated cylinder 8 and the inner cylinder 2. The lifting block extends into the isolated cylinder 8 through the isolation cylinder 8, or the lifting block can also be set on the inner side of the isolated cylinder 8. In washing, the particles 6 pass through the isolated cylinder 8 and mix with the clothes 5 fully. The particles 6 preferably employ polymer material with porous on the surface. The dirt of the clothes 5 and the wash water are adsorbed by utilizing the good adsorption ability of the particles 6 to achieve better washing effect.

A storage space 9 for storing the solid particles 6 is set in the washing machine. The storage space 9 is an extension part of the inner cylinder 2 extending from one side. Like the inner cylinder 2, the extension part is provided with opening holes 3 through which the washing water only pass. The extension part and the inner cylinder 2 are driven to rotate by a driving unit 4 synchronously. In the embodiment, as shown in FIG. 1, the inner cylinder 2 extends from the bottom direction. The side wall of the extension part is provided with the same spiral-shaped with the side wall of the inner cylinder 2, and forms a continuous spiral with the side wall of the inner cylinder 2. In the embodiment, the storage space 9 is the same shape with the inner cylinder 2, such as cylindrical, or circular shape. Of course, the inner cylinder 2 can also extend from the top, so the storage space 9 is arranged on the top of the inner cylinder 2. In order to put and take off the clothes 5 conveniently, the storage space 9 is circular.

The storage space 9 is communicated with the inner cylinder 2, and a baffle 10 for blocking clothes is arranged between the storage space 9 and the inner cylinder 2. The baffle 10 is located on radial center of the inner cylinder 2, and connects fixedly with the side wall of the inner cylinder 2 through a plurality of connecting plates (not shown in figure). A channel 7 for communicating the storage space 9 with the inner cylinder 2 each other is arranged between the circumference of the baffle 10 and the inner wall of the inner cylinder 2. The baffle 10 prevents the clothes 5 from going into the storage space 9, but the particles 6 can go in and out of the storage space 9 by the channel 7.

During the inner cylinder 2 rotating, the particles 6 are placed in the arc groove formed by the screw thread under the action of centrifugal force. The rotation of the screw thread drives the particles 6 to move forward or backward. At this time, the rotation speed of the inner cylinder 2 has no need to be very high; the washing speed can be realized. Generally the rotation speed is 50-200 r/min.

Figure 2:
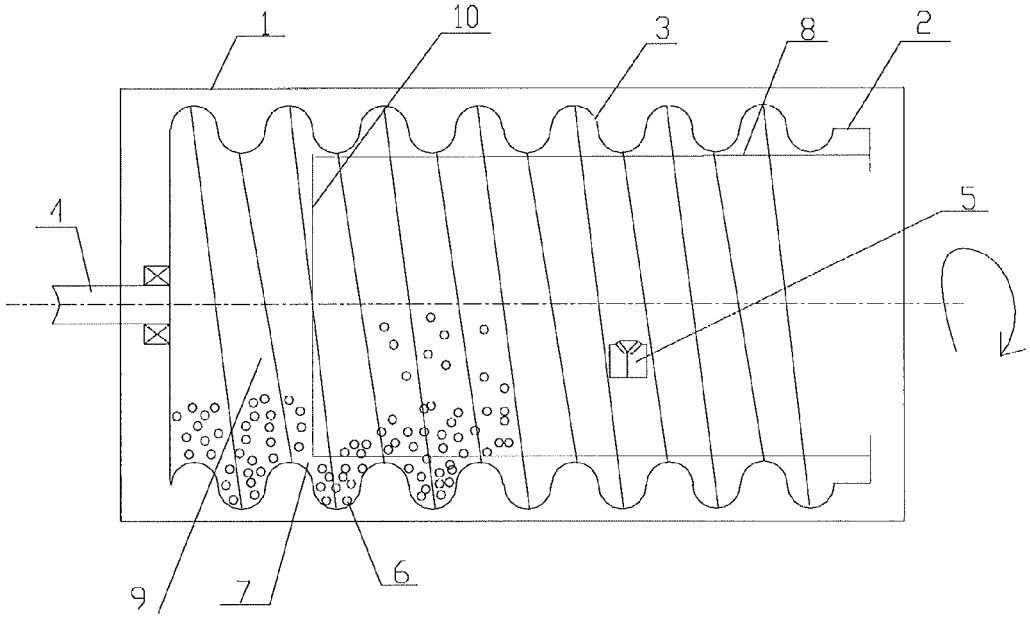
FIG. 2 is a schematic diagram of the putting process of the particles in the present invention.

As shown in FIG. 2, in the embodiment, the storage space 9 is arranged on one side of the bottom of the inner cylinder 2. When the rotation direction of the inner cylinder 2 and the extension part is same with the direction of the screw thread, and operating continuously along the direction, the particles 6 are driven to move to the inner cylinder 2 by the screw thread, and go into the inner cylinder 2 through the channel 7. Thus, the process of putting the particles 6 in the inner cylinder 2 is finished.

When the rotation direction of the inner cylinder 2 and the extension part is opposite to the direction of the screw thread, and operating continuously along the rotation direction, the particles 6 are driven to move to the storage space 9 by the thread, leave the inner cylinder 2 through the channel 7, and go into the storage space 9. Thus the process of recycling the particles 6 is finished.

In the recycling process, most of the particles 6 are recycled in the storage space 9. The inner cylinder 2 and the extension part rotate with high-speed; generally the rotation speed is 100-1000 r/min, and the rotation direction of the inner cylinder 2 and the extension part is opposite to the direction of the screw thread. The clothes 5 in the inner cylinder 2 and the particles 6 in the storage space 9 dewater simultaneously to recycle the particles 6. In the process of the dehydration, the residual particles 6 can continue to be separated and recycled, to achieve 100% recycling rate of the particles.

If the storage space is arranged on one side of the top of the inner cylinder 2, the rotation direction of the inner cylinder 2 is opposite to the foregoing during putting and recycling the particles 6.

In the process of washing, the inner cylinder 2 is operating positively and reversely alternately. Driven by the rotating positive and reverse alternately of the screw thread on the side wall of the inner cylinder 2, the particles 6 move forward and backward continuously in the inner cylinder 2. The particles move along the thread upward spirally, to a certain height, the particles 6 turn downward and fall into the inner cylinder 2 under its own gravity. Thus it is achieved to flipping forward and backward.

Figure 3:
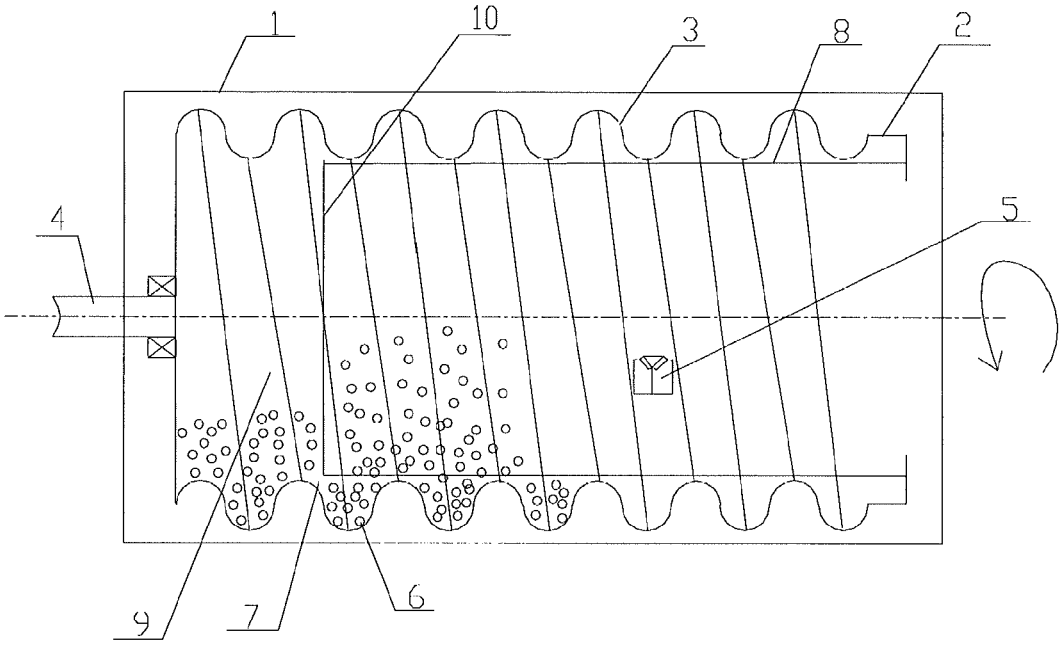
FIG. 3 is a schematic diagram of the recycling process of the particles in the present invention As shown in FIGS. 1 to 3: 1. an outer cylinder, 2. an inner cylinder, 3. an opening hole, 4. a driving unit, 5. clothes, 6. particles, 7. a channel, 8. an isolated cylinder, 9. a storage space, 10. a baffle.

The following describes in detail the washing method of the drum washing machine in company with FIGS. 1-3.

The washing method includes the following steps:

Step 1: putting the clothes 5 into the isolated cylinder 8 of the washing machine, and opening the water inlet at the top of the outer cylinder 1, adding water mixed with the detergent into the outer cylinder 1, fully mixing the water with the clothes 5 in the isolated cylinder 8 after the water passes through the opening holes 3 of the inner cylinder 2 and the isolated cylinder 8. In the process, the amount of the added water and detergent only need to ensure to soak the clothes 5 in the water.

During adding the washing water to soak the clothes to be washed, the clothes is soaked for a certain time for fully wetting the clothes, and further the cleaning effect is improved.

Step 2: as shown in FIG. 2, driving the inner cylinder 2 to rotate, the rotation direction of the inner cylinder 2 and the extension part is same with the direction of the screw thread, and operating continuously along the direction, and the particles 6 are driven to move to the inner cylinder 2 by the screw thread, pass through the channel 7, and go into the inner cylinder 2 continuously. Thus the process of putting the particles 6 in the inner cylinder 2 is finished.

In the process of putting the particles 6, the particles 6 in the inner cylinder 2 are driven continually flip by the rotation of the screw thread, and mix fully with clothes 5.

In this step, the rotation speed of the inner cylinder 2 is preferably 100-200 r/min.

Step 3: as shown in FIG. 1, all of the particles 6 are put into the inner cylinder 2, which can be controlled by defining the putting time. Subsequently, the driving unit 4 drives the inner cylinder 2 to rotate positively for some time, and stop, and then rotate reversely for some time. The screw thread rotates positively and reversely alternately, so the particles 6 move forward and backward continuously in the inner cylinder 2. The particles move along the thread upward spirally, to a certain height, the particles 6 turn downward and fall into the inner cylinder 2 by its own gravity. Thus it is achieved to flip forward and backward.

In the washing process, the particles 6, the clothes 5 and the washing water are fully mixed, and lifted and fallen constantly under the action of the lifting block. The washing of clothes is accomplished.

In the step, the rotation speed of the inner cylinder 2 is preferably 100-200 r/min.

Step 4: as shown in FIG. 3, after washing, the inner cylinder 2 is driven to rotate. In the process of rotation, the particles 6 are separated from the clothes 5. The particles 6 accumulate in the arc groove of the screw thread. Meanwhile, the rotation direction of the inner cylinder 2 and the extension part are opposite to the direction of the screw thread, and operating continuously along the rotation direction, the particles 6 are driven to move to the storage space 9 by the thread, pass through the channel 7, and be separated constantly. So the particles leave the inner cylinder 2 and enter the storage space 9, and the process of recycling the particles 6 to the storage space 9 is finished.

In the step, the rotation speed of the inner cylinder 2 is preferably 100-200 r/min.

Step 5: after the particles 6 are separated for the clothes 5 and recycled, the inner cylinder 2 rotates with high speed. The clothes 5 in the inner cylinder 2 and the particles 6 in the storage space 9 dewater simultaneously to recycle the particles 6. The water is collected in the outer cylinder 1 and discharged from the water outlet at the bottom of the outer cylinder 1. In the process, the rotation direction of the inner cylinder 2 and the extension part is opposite to the direction of the screw thread. The residual particles 6 can continue to be separated and recycled, to achieve 100% recycling rate of the particles.

In the step, the rotation speed of the inner cylinder 2 is 100-1000 r/min, generally higher than the washing speed.

Step 6: the rinsing step, adding appropriate amount of clean water to the outer cylinder 1 again, rinsing the clothes 5 according to the above mentioned process. At this time, the clean water also goes into the storage space 9. Both the clothes 5 and the particles 6 are rinsed simultaneously. Then dewater is operated again after rinsing. The few particles 6 is separated and recovered, the whole washing process is finished.

Embodiment 2

The difference from Embodiment 1 is that step 5 in Embodiment 1 is performed firstly. The inner cylinder 2 and the extension part are driven to rotate with high-speed, and the rotation direction of the inner cylinder 2 and the extension part is opposite to the direction of the screw thread. The clothes 5 and the particles 6 dewater. During dewatering, it is realized to separate the clothes 5 from the particles 6. At the same time, parts of the particles 6 is driven to move to the storage space 9 by the screw thread, return to the storage space 9.

Then step 4 in Embodiment 1 is performed. The inner cylinder 2 and extension part are driven to rotate with the washing rotation speed. The rotation direction of the inner cylinder 2 and the extension part is opposite to the direction of the screw thread, and operating continuously along the direction, so that the residual particles 6 can continue to be separated and recycled, to be recycled by recycling rate 100%.

Embodiment 3

The difference from Embodiment 1 is that step 4 in embodiment 1 is deleted and directly performing step 5 in Embodiment 1. The inner cylinder 2 and extension part are driven to rotate with high speed, and the rotation direction of the inner cylinder 2 and the extension part is opposite to the direction of the screw thread. The clothes 5 and the particles 6 dewater. During dewatering, it is realized to separate the clothes 5 from the particles 6. At the same time, parts of the particles 6 is driven to move to the storage space 9 by the screw thread, return to the storage space 9. In the process, the time for the rotation of the inner cylinder 2 with high speed is needed to be lengthened, to ensure that the particles 6 is completely recovered to the storage space 9.

Embodiment 4

The difference from Embodiment 1 is that the storage space is a storage box structure, which is arranged on the outside wall of the outer cylinder 1. The storage space 9 is connected with the inner cylinder 2 directly through the wall of the outer cylinder 1. The communicating hole between the storage space 9 and the inner cylinder 2 is arranged on the end position of the inner cylinder 2.

After washing, the inner cylinder 2 is driven to rotate. In the process of rotation, the particles 6 are separated from the clothes 5, and the particles 6 accumulate in the arc groove of the screw thread. Meanwhile, the rotation direction of the inner cylinder 2 and the extension part is opposite to the direction of the screw thread, and operating continuously along the direction. The particles 6 are driven to move to the storage space 9 by the screw thread, and go in the storage space 9 through the communication hole. The particles 6 are isolated constantly, and leave the inner cylinder 2 and go in the storage space 9. Thus the process of recycling the particles to the storage space is complete.

Embodiment 5

Like the drum washing machine in Embodiment 1, the side wall of the inner cylinder of the pulsator washing machine is spirally shaped. During washing, the inner cylinder 2 rotates positively and reversely alternately. Driven by the alternately positive and reverse rotation of the screw thread on the side wall of the inner cylinder 2, the particles 6 move and flip along the axis of the inner cylinder 2 upward and downward. The clothes 5 is mixed more fully with the particle 6 to improve the cleaning rate.

Like Embodiment 1, in order to separate the clothes from the particles conveniently, an isolated cylinder is provided along the inner side of the inner cylinder. The isolated cylinder is connected with the inner cylinder by fasteners, and rotates synchronously with the inner cylinder. The isolated cylinder is reticular structure, so that the particles and the washing water flow into or out of the isolated cylinder. The clothes are isolated in the isolated cylinder, and the particles are isolated between the isolated cylinder and the inner cylinder.

Like Embodiment 1, the storage space of the particles is the extension part of the inner cylinder 2 extending downward. The side wall of the extending part is the same spiral shaped with the side wall of the inner cylinder 2, and forms a continuous spiral with the side wall of the inner cylinder 2. The storage space 9 is communicated with the inner cylinder 2. A baffle 10 is located between the storage space 9 and the inner cylinder 2. A channel 7 for communicating the storage space with the inner cylinder each other is arranged between the circumference of the baffle and the inner side wall of the inner cylinder. The baffle 10 prevents the clothes 5 from going in the storage space 9, and the particles 6 go in and out of the storage space 9 through the channel 7.

The washing process of the washing machine said in the present embodiment is same with Embodiment 1, Embodiment 2, and Embodiment 3, so there is no other description in detail.

As mentioned above, the given program combined with Figures, can be derived from similar technical scheme. But the schemes that are not out of the technical scheme of the invention, and any simple modification, equal transformation and modification of the examples said above, on the basis of the essence of the invention are still belongs to the scope of the technical scheme of the invention.

The invention claimed is:

1. A washing machine, comprising an inner cylinder, an outer cylinder, and solid particles as washing medium, the inner cylinder being driven to rotate by a driver unit, wherein, a side wall of the inner cylinder is spirally shaped, and the particles are driven to move and turn spirally within the inner cylinder, an isolated cylinder with reticulated structure configured to separate clothes from the particles is arranged along an inner side of the inner cylinder, a storage space configured to store the particles is arranged in the washing machine, and the storage space communicates with the inner cylinder the storage space configured to store the particles is an extension part of the inner cylinder extending from one side, a baffle is configured to block clothes between the storage space and the inner cylinder, and a side wall of the extension part and the side wall of the inner cylinder are continuously spirally shaped.

2. The washing machine according to claim 1, wherein a screw thread is disturbed all over the side wall of the inner cylinder from a bottom to a top.

3. The washing machine according to claim 1, wherein, a bottom and a top of the isolated cylinder are connected fixedly with a bottom and a top of the inner cylinder respectively.

4. The washing machine according to claim 1, wherein, a channel configured to communicate the storage space with the inner cylinder is provided between a circumference of the baffle and the inner side wall of the inner cylinder.

5. The washing machine according to claim 4, wherein a cross section of a screw thread on the inner cylinder and the extension part is streamline.

6. The washing machine according to claim 4, wherein, a screw thread on the inner cylinder and the extension part is equal screw-pitch thread or unequal screw-pitch thread.

7. The washing machine according to claim 1, wherein a cross section of a screw thread on the inner cylinder and the extension part is streamline.

8. The washing machine according to claim 1, wherein, a screw thread on the inner cylinder and the extension part is equal screw-pitch thread or unequal screw-pitch thread.

9. The washing machine according to claim 8, wherein, the screw-pitch of the screw thread on the inner cylinder and the extension part is greater than or equal to 5 mm, a height of a cross-section of the screw thread is greater than or equal to 5 mm.

10. The washing machine according to claim 9, wherein, the screw-pitch of the screw thread on the inner cylinder and the extension part is 8-15 mm;

the height of the cross-section of the screw thread is 8-15 mm.

11. A washing method for use with the washing machine according to claim 1, wherein, the side wall of the inner cylinder of the washing machine is spirally shaped, during rotating of the inner cylinder, the particles as a washing medium are driven to spirally move and turn within the inner cylinder, thus the particles mix with the clothes and washing water and turn together, and washing of the clothes is completed.

12. The washing method according to claim 11, wherein, driving the inner cylinder to continuously rotate according to a same direction or an opposite direction of the screw thread, the particles are driven to move to the side of the inner cylinder by a screw thread, finishing putting the particles; or the particles are driven to move away from the inner cylinder by the screw thread, finishing recycling the particles.

13. The washing method according to claim 12, wherein, a storage space configured to store the particles is an extension part of the inner cylinder extending from one side, a side wall of the extension part and the side wall of the inner cylinder are continuously spirally shaped, the extension part and the inner cylinder rotate synchronously, the particles are driven to move away from the inner cylinder by the screw thread and be recycled to the storage space.

14. The washing method according to claim 13, wherein, after the particles are recycled to the extension part, or before the particles are recycled to the extension part, or when the particles are recycled to the extension part, the inner cylinder and the extension part rotate with a speed of 100-1000 r/min, thus the particles move to the extension part, and realize a process of dehydration and regeneration of the particles and the clothes at the same time.

15. The washing method according to claim 12, wherein, during washing the clothes, putting and recycling the particles, the inner cylinder rotates with a speed of 50-200 r/min.

16. The washing method according to claim 11, wherein, during washing the clothes, putting and recycling the particles, the inner cylinder rotates with a speed of 50-200 r/min.

* * * * *